US007213639B2

(12) United States Patent
Danielsson et al.

(10) Patent No.: US 7,213,639 B2
(45) Date of Patent: May 8, 2007

(54) HEAT EXCHANGER EXHAUST GAS RECIRCULATION COOLER

(75) Inventors: Dennie Bengt-Ake Danielsson, Stuttgart (DE); Mark Louis DiCea, Waterford, MI (US)

(73) Assignee: Detroit Diesel Coporation, Detroit, MI (US)

( * ) Notice: Subject to any disclaimer, the term of this patent is extended or adjusted under 35 U.S.C. 154(b) by 79 days.

(21) Appl. No.: 11/082,075

(22) Filed: Mar. 16, 2005

(65) Prior Publication Data

US 2006/0207757 A1 Sep. 21, 2006

(51) Int. Cl.
*F28D 7/12* (2006.01)

(52) U.S. Cl. ..... 165/159; 165/155

(58) Field of Classification Search ..... 165/154, 165/155, 158, 159, 172–176
See application file for complete search history.

(56) References Cited

U.S. PATENT DOCUMENTS

| | | | | | |
|---|---|---|---|---|---|
| 2,468,903 | A | * | 5/1949 | Villiger | 165/155 |
| 2,774,575 | A | * | 12/1956 | Walter | 165/158 |
| 3,187,807 | A | * | 6/1965 | Ammon | 165/158 |
| 3,395,076 | A | * | 7/1968 | Ruppen, Jr. | 165/158 |
| 4,294,220 | A | | 10/1981 | Yasuhara et al. | |
| 4,589,481 | A | * | 5/1986 | Mansson | 165/172 |
| 4,660,632 | A | * | 4/1987 | Yampolsky et al. | 165/158 |
| 4,858,681 | A | * | 8/1989 | Sulzberger | 165/158 |
| 5,174,271 | A | * | 12/1992 | Seo | 165/159 |
| 5,207,714 | A | | 5/1993 | Hayashi et al. | |
| 6,044,827 | A | | 4/2000 | Pfaff et al. | |
| 6,293,265 | B1 | | 9/2001 | Gagnon | |
| 6,427,671 | B1 | | 8/2002 | Holze et al. | |
| 6,568,466 | B2 | | 5/2003 | Lowenstein et al. | |
| 6,672,292 | B2 | | 1/2004 | Fischer | |
| 6,808,017 | B1 | | 10/2004 | Kaellis | |
| 2002/0088611 | A1 | * | 7/2002 | Geissler et al. | 165/158 |
| 2003/0150434 | A1 | | 8/2003 | Leedham et al. | |
| 2004/0107949 | A1 | | 6/2004 | Miyoshi et al. | |
| 2004/0206342 | A1 | | 10/2004 | Moyer et al. | |

* cited by examiner

*Primary Examiner*—Teresa J. Walberg
(74) *Attorney, Agent, or Firm*—Brooks Kushman P.C.

(57) ABSTRACT

A two-pass, loop flow heat exchanger includes an inlet plenum that receives a fluid to be cooled, a housing, a plurality of inlet flow passages substantially centrally positioned within the housing and having a first end fluidly coupled to the inlet plenum to receive the fluid, a turnaround plenum fluidly coupled to a second end of the inlet flow passages for reversing the flow of the fluid, a plurality of outlet flow passages peripherally positioned within the housing and having a first end fluidly coupled to the turnaround plenum, and an outlet plenum fluidly coupled to a second end of the outlet flow passages to present the fluid.

20 Claims, 3 Drawing Sheets

HEAT EXCHANGER EXHAUST GAS RECIRCULATION COOLER

BACKGROUND OF THE INVENTION

1. Field of the Invention

The present invention relates to a system and a method for a heat exchanger.

2. Background Art

Heat exchanger assemblies, such as an automobile radiator, an exhaust gas recirculation (EGR) cooler, and the like are typically used to transfer heat from a fluid on one side of a barrier to a fluid on the other side without bringing the fluids into direct contact. Heat exchangers are used with several types of fluids, for example: air-to-air, air-to-water or water-to-water (or exhaust gas, coolant, etc.).

However, conventional heat exchangers have a number of deficiencies. The deficiencies of conventional heat exchangers include thermal stress in critical areas at the inlet which can cause fractures and failures of the heat exchanger, local "hot spots" due to stagnant water flow areas by the hot passage, poorly shaped return tank and poor flow distribution, excessive gas pressure loss through the cooler thereby causing poor cooler thermal efficiency, trapped vapor pockets (e.g., bubbles) and film boiling in liquid coolant, poor heat rejection, re-circulation on the inlet side of the header tank and non-uniform gas mass flux to the inlet tubes, re-circulation of coolant in the heat exchanger (in particular, re-circulation of coolant at the turnaround section), and excessive coolant flow short circuit (i.e., coolant that does not flow past the gas flow tubes) velocities (and reduced coolant flow across the gas tubes).

Thus, there exists a need and an opportunity for an improved system and an improved method for heat exchangers that addresses some or all of the deficiencies noted above.

SUMMARY OF THE INVENTION

The present invention generally provides new, improved and innovative techniques for heat exchangers. The present invention generally provides a system and a method for heat exchangers that may reduce or eliminate deficiencies of conventional approaches such as thermal stress in critical areas at the inlet, local "hot spots" due to stagnant water flow areas by the hot passage, poorly shaped return tank and poor flow distribution, excessive gas pressure loss through the cooler, trapped vapor pockets (e.g., bubbles) and film boiling in liquid coolant, poor heat rejection, re-circulation on the inlet side of the header tank and non-uniform gas mass flux to the inlet tubes, re-circulation of coolant in the heat exchanger (in particular, re-circulation of coolant at the turnaround section), excessive coolant flow short circuit velocities, and reduced coolant flow across the gas tubes.

According to the present invention, a two-pass, loop flow heat exchanger is provided. The heat exchanger comprises an inlet plenum that receives a fluid to be cooled, a housing, a plurality of inlet flow passages substantially centrally positioned within the housing and having a first end fluidly coupled to the inlet plenum to receive the fluid, a turnaround plenum fluidly coupled to a second end of the inlet flow passages for reversing the flow of the fluid, a plurality of outlet flow passages peripherally positioned within the housing and having a first end fluidly coupled to the turnaround plenum, and an outlet plenum fluidly coupled to a second end of the outlet flow passages to present the fluid.

Also according to the present invention, a method of performing a heat exchange operation using a two-pass, loop flow heat exchanger is provided. The method comprises presenting a fluid to be cooled to an inlet plenum, positioning a plurality of inlet flow passages substantially centrally within a housing and fluidly coupling a first end of the inlet flow passages to the inlet plenum to receive the fluid, fluidly coupling a turnaround plenum to a second end of the inlet flow passages for reversing the flow of the fluid, positioning a plurality of outlet flow passages peripherally within the housing, and fluidly coupling a first end of the outlet flow passages to the turnaround plenum, and fluidly coupled an outlet plenum to a second end of the outlet flow passages to present the fluid.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Figure 1:
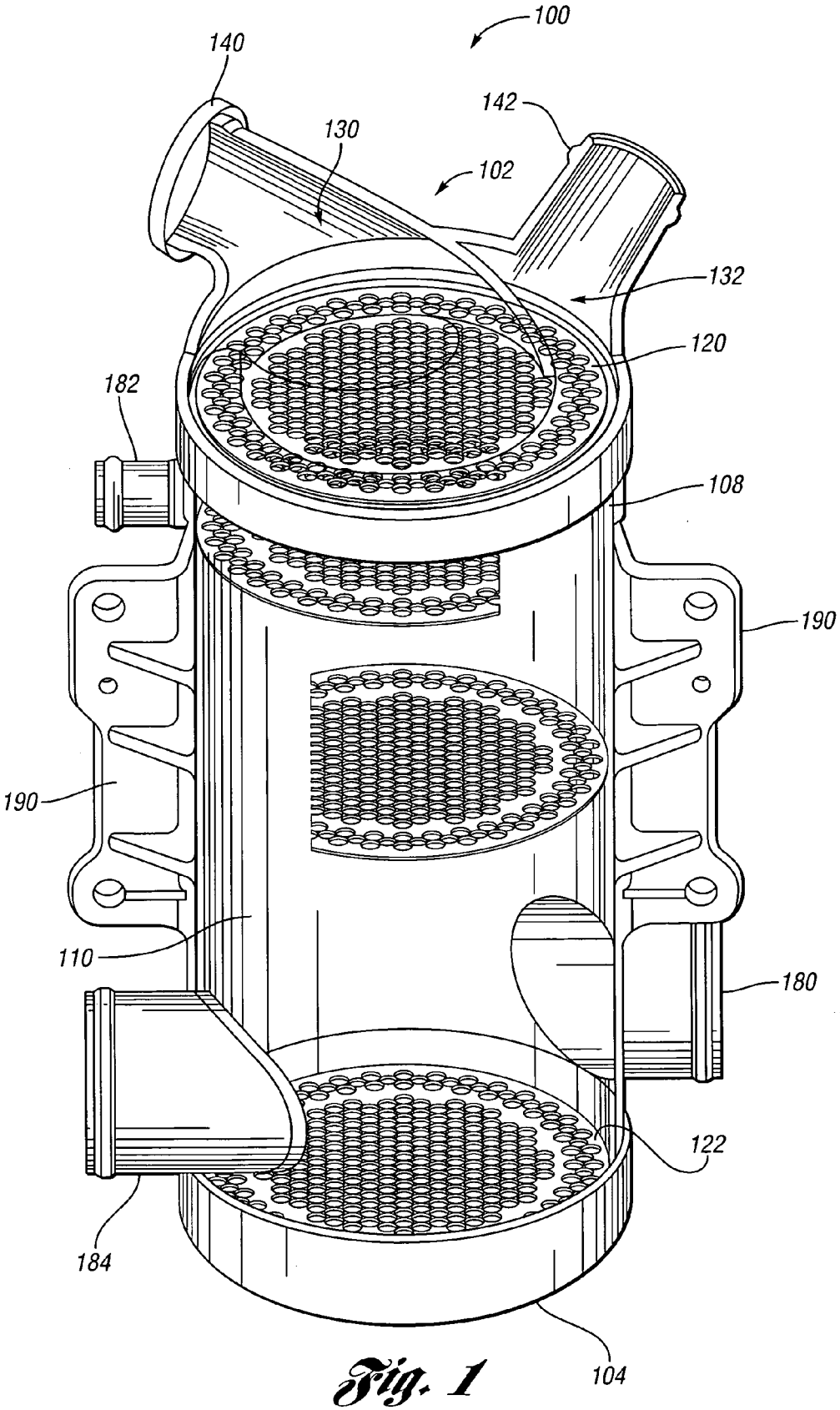
FIG. 1 is a diagram illustrating a simplified isometric, cutaway view of an example of a heat exchanger of the present invention.

With reference to the Figures, the preferred embodiments of the present invention will now be described in detail. Generally, the present invention provides an improved system and an improved method for heat exchangers. In one example, the heat exchanger of the present invention may advantageously implemented as an exhaust gas recirculation (EGR) gas cooler. However, the heat exchanger of the present invention may used in connection with any appropriate application to transfer heat from a fluid on one side of a barrier to a fluid on the other side without bringing the fluids into direct contact. Heat exchangers implemented in accordance with the present invention may be used with several types of fluids, for example: air-to-air, air-to-water or water-to-water (or exhaust gas, coolant etc.), fluid to solid or semi-solid, etc. or combination thereof as appropriate to meet the design criteria of a particular application.

The present invention generally provides for having a hot fluid (or gas) stream (i.e., the fluid to be cooled via the heat exchange operation performed using the heat exchanger of the present invention) passing through the center of the heat exchanger, and for cooled (or outlet) fluid (e.g., gas) shielding the hot (or inlet) gas from all sides. The inlet and outlet gas paths are generally separated by any appropriate structure to meet the design criteria of a particular application. The shape of the external housing of the heat exchanger of the present invention may be round, square, triangular, oval, "kidney", etc., i.e., any appropriate shape to meet the design criteria of a particular application.

The benefits derived from the present invention do not generally depend on orientation of the heat exchanger. The implementation of a central hot gas passage within a cooled gas passage according to the present invention is generally applicable for all orientations, and for heat exchangers of all types (e.g., air-to-air, air-to-water or water-to-water (or exhaust gas, coolant, semi-solid, etc.)).

The present invention generally provides for reduced thermal stress at the inlet for the cooled fluid. The present invention generally provides for reduced thermal differentials between inlet and outlet interfaces, and, therefore, coolant "short circuit" paths (i.e., coolant flow paths around rather than through passages carrying the fluid to be cooled) may have smaller passages than in conventional approaches. As such, the efficiency of the heat exchanger of the present invention may be greater than in conventional approaches.

The present invention generally reduces the risk of local "hot spots" due to the elimination of stagnant coolant flow areas by the hot passage on the water (coolant) side. In one example of the present invention, a "piston bowl", "dog dish", "donut", generally annular shaped return tank may provide improved flow distribution via a "flow within flow". The "flow within flow" heat exchangers of the present invention may be implemented in connection with any appropriate applications, and the benefit may be most advantageously realized when implemented in connection with a very large temperature differential between inlet and outlet sides of the cooled fluid.

The present invention generally provides improved heat rejection capacity that may accommodate increased EGR rates. The present invention may minimize gas pressure loss of the cooled fluid through the cooler thereby providing improved cooler thermal efficiency, reduce or prevent trapped vapor pockets (e.g., bubbles) and film boiling in liquid coolant, improve heat rejection, minimize re-circulation on the inlet side of the header tank and thereby provide more uniform gas mass flux to the inlet tubes, minimize re-circulation of coolant in the heat exchanger (in particular, minimize re-circulation of coolant at the turnaround section), reduce coolant flow short circuit (i.e., coolant that does not flow past the gas flow tubes) velocities (and increase coolant flow across the gas tubes) by having a reduced gap between the gas tubes and the coolant jacket when compared to conventional approaches.

Figure 2:
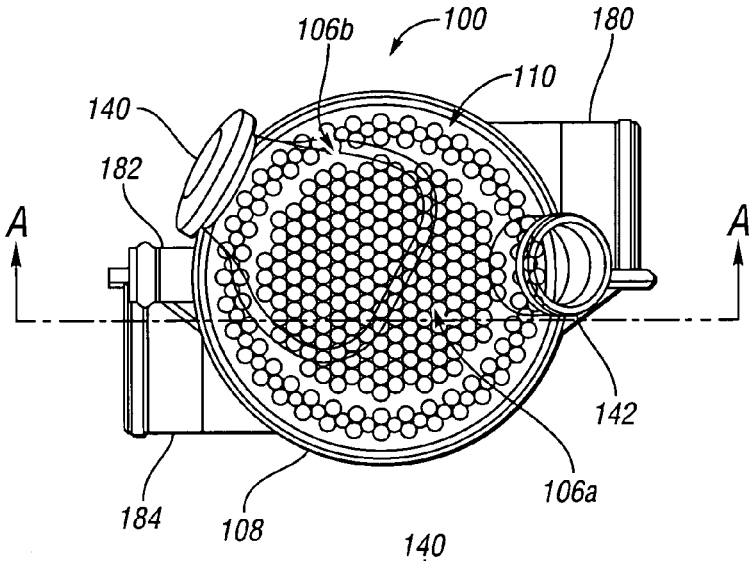
FIG. 2 is a top cutaway view of the heat exchanger of FIG. 1.
Figure 3:
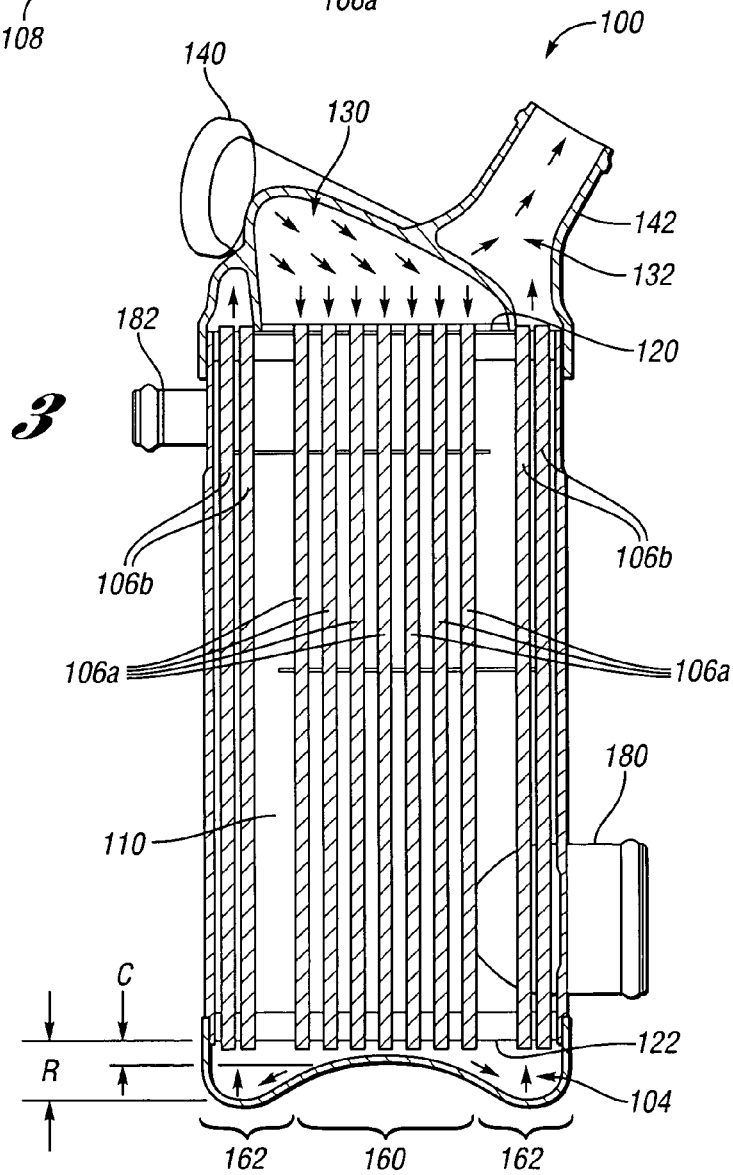
FIG. 3 is a sectional side view of the heat exchanger of FIG. 1.

Referring to FIG. 1, a diagram illustrating an isometric, simplified cutaway view of an example of a heat exchanger 100 of the present invention is shown. Referring to FIG. 2, is a top cutaway view of the heat exchanger 100 is shown. Referring to FIG. 3, a diagram illustrating a sectional view of the heat exchanger 100 taken at the line A—A of FIG. 2 is shown.

Referring generally to FIGS. 1–3, the heat exchanger 100 generally comprises a top fluid plenum (e.g., manifold, tank, section, end, cavity, region, area, header tank, etc.) 102, a bottom fluid plenum (e.g., manifold, tank, section, end, cavity, region, area, turnaround, etc.) 104, a plurality of hollow passage ways (e.g., tubes, pipes, flow tubes, passages, and the like) 106 (not shown in FIG. 1 for clarity, shown in FIGS. 3–5) arranged in a substantially parallel, spaced-apart relationship (e.g, orientation, placement, etc.), and a housing 108 for enclosing passage ways 106 and mechanically coupled to and between the sections 102 and 104. The heat exchanger 100 generally further comprises separator plates (e.g., dividers, walls, bulkheads, etc.) 120 and 122 having holes for receiving and mounting the tubes 106.

The walls 120 and 122, in connection with the housing 108, generally form a coolant (or cooling) chamber (i.e., body) 110 having the tubes 106 contained therewithin. The dividers 120 and 122 also generally form a portion of the walls that comprise the plenums 102 and 104, respectively. The inlet manifold 102 is generally mechanically and hermetically coupled to a first end of the housing 108. The outlet manifold 104 is generally mechanically and hermetically coupled to a second end of the housing 108. The heat exchanger 100 is generally implemented as a two-pass, loop flow (e.g., serpentine flow) heat exchanger.

In one example, the heat exchanger 100 as illustrated in FIG. 1 may be advantageously implemented as an EGR gas cooler. While the heat exchanger 100 is described herein in connection with an implementation as an EGR cooler, such description is for clarity of illustration, and not a limitation on the possible implementations and applications of the present invention as understood by one skilled in the art.

The top plenum region 102 generally comprises an inlet region (e.g., section, portion, area, sub-manifold, plenum, etc.) 130, and an outlet region (e.g., section, portion, area, sub-manifold, plenum, etc.) 132. The regions 130 and 132 may share adjacent wall structures (e.g., sections of the wall 120). However, the regions 130 and 132 are separated such that fluid that is introduced into the inlet sub-manifold 130 passes through some of the tubes 106 (e.g., tubes 106*a*), into the plenum 104, through others of the tubes 106 (e.g., tubes 106*b*), and into the outlet sub-manifold 132. The inlet plenum 130 is generally not directly fluidly coupled to the outlet plenum 132. The inlet plenum 130 is generally indirectly fluidly coupled to (i.e., in fluid communication with) the outlet plenum 132 via the tubes 106 and the manifold 104.

The inlet plenum 130 generally includes an inlet (e.g., fitting, coupling, connector, etc.) 140. The inlet plenum 130 generally receives a fluid (e.g., liquid, gas, semi-solid, vapor, air, exhaust gas, vaporous mixture, etc.) that is to be cooled at the inlet 140. The outlet plenum 132 generally includes an outlet (e.g., fitting, coupling, connector, etc.) 142. The outlet plenum 132 generally presents cooled fluid (i.e., the fluid to be cooled after cooling) at the outlet 142.

The inlet portion 130 and the outlet portion 132 are generally shaped substantially as truncated cones having the inlet 140 and the outlet 142, respectively, at the narrow ends of the cones. The inlet 140 and the outlet 142 are generally oriented (i.e., pointed, positioned, placed, etc.) to provide an efficient (e.g., unobstructed) hook up (i.e., connection, coupling, etc.) to respective connecting members (e.g., hoses, pipes, etc., not shown).

The passage ways 106 generally comprise inlet tubes 106*a* that are fluidly coupled to the inlet sub-manifold 130 to receive the fluid that is to be cooled at a first end and fluidly coupled to the plenum 104 at a second end, and outlet tubes 106*b* that are fluidly coupled to the plenum 104 at a first end and to the outlet sub-manifold 132 at a second end that presents the cooled fluid into the sub-manifold 132. The inlet tubes 106*a* are generally positioned (i.e., displaced, arranged, set, configured, disposed, etc. substantially centrally within the cooling chamber 110 (e.g., away from the housing 108). The outlet tubes 106*b* are generally positioned (i.e., displaced, arranged, set, configured, disposed, etc. substantially peripherally within the cooling chamber 110 (e.g., near the housing 108). That is, the inlet tubes 106*a* are "inner" passage ways, and the outlet tubes 106*b* are "outer" passage ways for the fluid that is to be cooled.

The inlet passages 106*a* and outlet passages 106*b* are generally provided in size or number such that the total cross-sectional area of the inlet of the passages 106*a* to which the fluid to be cooled is presented is essentially (i.e., approximately, substantially, about, etc.) 1.5 times the total cross-sectional area of the inlet of the outlet passages 106*b* to which the fluid to be cooled is presented. The ratio of the total cross-sectional area of the inlet passages 106*a* to the total cross-sectional area of the outlet passages 106*b* may be in a range of 1:1 to 3:1 (i.e., 1 to 1–3 to 1), a preferred range of 1.25:1 to 2:1 (i.e. 1.25 to 1–2 to 1), a most preferred range of 1.35:1 to 1.7:1 (i.e., 1.35 to 1–1.7 to 1).

In one example, the passage ways 106 may be implemented as substantially circular tubes (or pipes). In another example (not shown), the passage ways 106 may be implemented as tubes having a substantially oval shape. In yet another example (not shown), the passage ways 106 may be implemented as tubes having a substantially square or rectangular shape. In yet another example (as described in more detail in connection with elements 106' of FIGS. 4 and 5), the passage ways 106 may be implemented as circular tubes (or pipes) having a helical twist (or indentations that provide a helical shape). However, the passage ways 106 may be implemented having any appropriate shape to meet the design criteria of a particular application.

The fluid to be cooled generally circulates through heat exchanger 100 in a substantially serpentine (e.g., two-pass) path. The fluid to be cooled generally enters the heat exchanger 100 via the inlet 140, flows through the plenum 130 into the substantially centrally positioned inlet passage ways 106*a*, out of the inlet passage ways 106*a* and into the plenum 104 where the fluid to be cooled reverses flow direction (i.e., the plenum 104 may be configured as a "turn around" for the fluid to be cooled) and enters the outlet passage ways 106*b*, through the passage ways 106*b* into the outlet plenum 132, and the cooled fluid to be cooled is presented by the outlet 142.

In one example, the plenum 104 may be substantially annular (e.g., ring, donut, etc.) shaped with a substantially disc shaped offset (e.g., biased towards the plate 122) center section (e.g., portion, region, area, etc.) 160 and an outer ring section (e.g., portion, region, area, etc.) 162. The center area 160 is generally sized to about the same size as and positioned at the region of the divider 122 where the inlet passages 106*a* are mounted at the plenum 104, and the outer ring region 162 is generally sized to about the same size as and positioned at the region of the divider 122 where the outlet passages 106*b* are mounted at the plenum 104. The center area 160 is generally separated from the inlet passages 106*a* at the plate 122 by a thickness C. The outer ring area 162 is generally separated from the outlet passages 106*b* at the plate 122 by a thickness R. The transitions between the regions 160 and 162 are generally gradually tapered such that the flow of the fluid to be cooled through the turnaround 104 is substantially non-turbulent.

The ratio of the center 160 thickness C to the ring thickness R may be in a range of 1:1 to 0.1:1 (i.e., 1 to 1–0.1 to 1) (i.e., at one extreme, the thicknesses C and R may be substantially the same and the side of the plenum 104 opposite the divider 122 may be substantially flat, and at the other extreme, the center thickness C may be 1/10 the outer ring thickness R), a preferred range of 0.8:1 to 0.5:1 (i.e., 0.8 to 1–0.5 to 1), and a most preferred range of 0.6:1 to 0.2:1 (i.e., 0.6 to 1–0.2 to 1), and have a nominal value of 0.3:1 (i.e., 0.3 to 1).

The heat exchanger 100 generally receives the fluid (e.g., liquid, gas, vapor, etc.,) to be cooled through the inlet fitting 140. The fluid to be cooled generally circulates through the heat exchanger 100 and a heat exchange operation is generally performed therein. In fluidly coupled combination, the top and bottom fluid manifolds 102 and 104 and passage ways 106 generally provide a continuous flow path for the fluid to be cooled through the heat exchanger 100. The internally circulated and cooled fluid may be discharged from the heat exchanger 100 through the outlet fitting 142. In one example (not shown), the heat exchanger 100 may include multiple inlet fittings 140 and/or outlet fittings 142 to meet the design criteria of a particular application.

The housing 108 generally comprises an inlet (e.g., fitting, coupling, connector, etc.) 180 and an outlet 182. In one example, an auxiliary outlet (e.g., a by-pass outlet) 184 may be included on the housing 108. The inlet 180 generally receives a fluid (e.g., liquid, gas, semi-solid, vapor, air, engine coolant from the outlet side of a radiator, etc., hereinafter referred to as a coolant) that provides transfer of heat away from the fluid to be cooled. The housing 108 generally presents the circulated coolant at the outlet 182, and alternatively, also at the outlet 184. The coolant generally enters the cooling chamber 110 via the inlet 180, circulates around the tubes 106*b* and 106*a*, and exits the chamber 110 via the outlet 182, and alternatively, also at the outlet 184.

In a heat exchanger such as the heat exchanger 100, there may be a so-called short circuit coolant flow path between the outlet flow tubes 106*b* and the inner surface of the housing 108. However, in the heat exchanger 100 because mechanical stress at the divider 120 may be reduced when compared to conventional approaches, the so-called short circuit coolant flow path is generally smaller than in conventional approaches. Thus, the efficiency of the heat exchanger of the present invention is generally more efficient than a similarly sized conventional heat exchanger.

Extreme thermal gradients (e.g., high temperature differentials or "deltas") between adjacent elements of the present invention may be reduced or eliminated when compared to conventional approaches because the present invention is implemented having the fluid to be cooled presented centrally within the housing 108, and thus centrally within the cooling chamber 110. As such, when compared to conventional approaches mechanical stress at the divider 120 may be reduced, local "hot spots" due to stagnation of coolant flow may be reduced, trapped vapor pockets and film boiling in the coolant may be reduced, and pressure loss of the fluid to be cooled may be reduced. Further, re-circulation of coolant in the heat exchanger 100 (in particular, re-circulation of coolant at the turnaround section 104), may be reduced when compared to conventional approaches.

The reduction of extreme thermal gradients and mechanical stresses may be beneficially achieved at the interface (i.e., connection, weld, attachment, transition, etc.) of the header plenum 102 and the housing 108. In one example simulation (an example having a circular housing 108), the stress reduction was 76–86% and the temperature reduction was 57–69 deg C. for a heat exchanger of the present invention when compared to a conventional approach.

Figure 4:
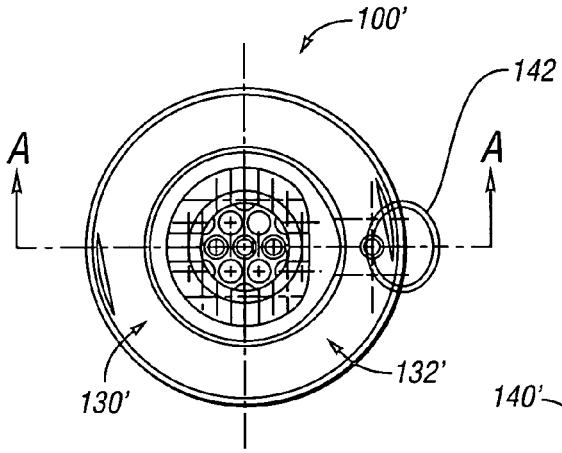
FIG. 4 is a diagram illustrating a top cutaway view of another example of a heat exchanger of the present invention.

In one example, the housing 108 may have a substantially cylindrical shape with a substantially circular cross-section as illustrated in FIGS. 1, 2 and 4. In another example (not shown), the housing 108 may have a substantially square cross-section. In yet another example (not shown), the housing 108 may have a substantially triangular cross-section. In another example (not shown), the housing 108 may have a substantially kidney-shaped cross-section. However, the housing 108 may have any appropriate shape to meet the design criteria of a particular application (e.g., a shape to conform to packaging space). In any case, the heat exchanger 100 generally implements a two-pass flow pattern having the inlet of the fluid to be cooled at cooling passages that are substantially centrally located in the housing 108 and outlet of the fluid to be cooled at cooling passages that are substantially peripherially located in the housing 108.

The housing 108 may also have one or more brackets 190 that generally provide a structure to mechanically fasten the heat exchanger 100 at a desired position in connection with the design criteria of a particular application. The brackets 190 are generally produced with an appropriate shape and fixed to the heat exchanger 100 in appropriate locations for the design criteria of the application.

Figure 5:
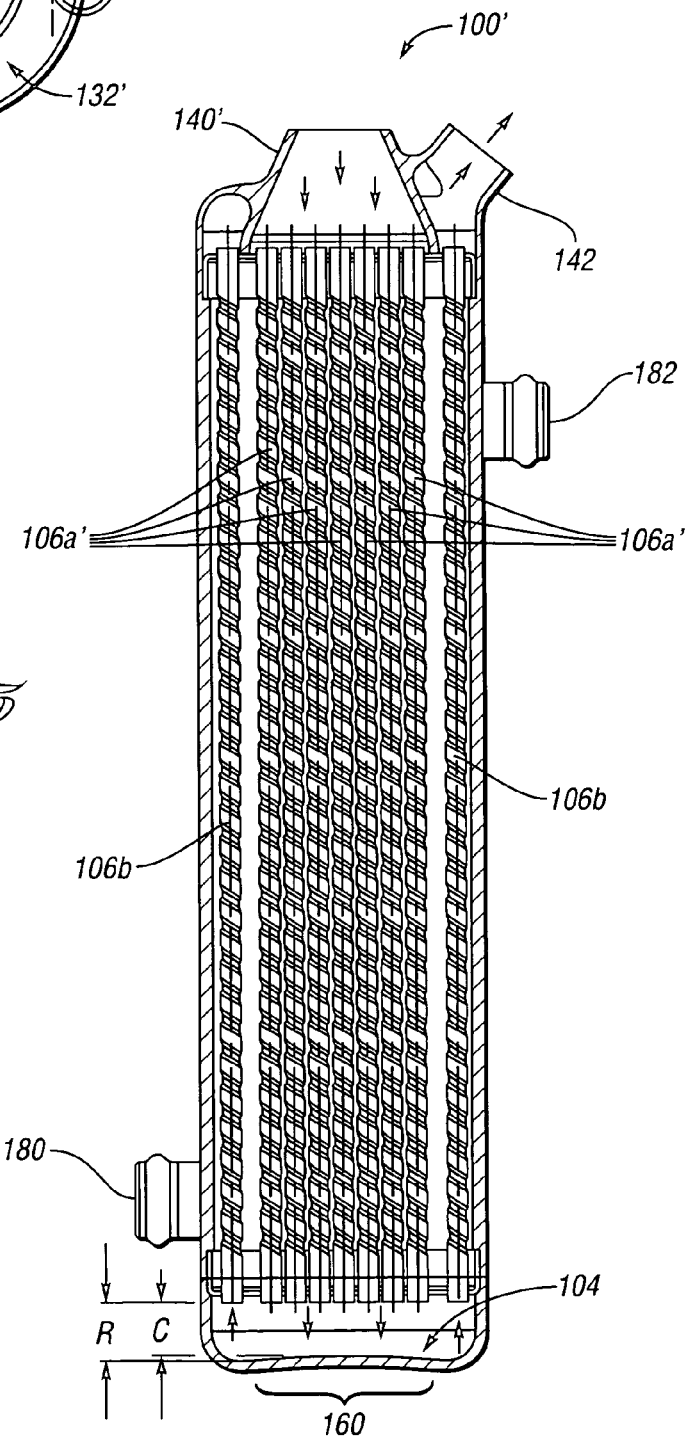
FIG. 5 is a sectional side view of the heat exchanger of FIG. 4.

Referring to FIGS. 4 and 5, diagrams illustrating a heat exchanger 100' is shown. Referring to FIG. 4, is a top cutaway view of the heat exchanger 100' is shown. Referring to FIG. 5, a diagram illustrating a sectional view of the heat exchanger 100' taken at the line A—A of FIG. 4 is shown. The heat exchanger 100' may be another example of a heat exchanger according to the present invention. The heat exchanger 100' may be implemented similarly to the heat exchanger 100. The heat exchanger 100' generally comprises a header plenum 102' having an inlet region 130' with an inlet 140' and an outlet region 132', and flow passages 106'.

The inlet region 130' may be substantially conically shaped and the inlet 140' may be substantially parallel with the flow tubes 106'. The outlet region 132' may be substantially annular (e.g., ring, donut, etc. shaped). The flow tubes 106' may be formed having a substantially helically twisted shape.

As is readily apparent from the foregoing description, then, the present invention generally provides an improved apparatus and an improved method for heat exchangers. The improved system and method of the present invention may provide reduced thermal differentials at element interfaces, and improved efficiency when compared to conventional approaches.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A two-pass, loop flow heat exchanger, the heat exchanger comprising:

an inlet plenum that receives a fluid to be cooled;

a housing;

a plurality of inlet flow passages substantially centrally positioned within the housing and having a first end fluidly coupled to the inlet plenum to receive the fluid;

a turnaround plenum fluidly coupled to a second end of the inlet flow passages for reversing the flow of the fluid without mechanical assistance of a moving element;

a plurality of outlet flow passages peripherally positioned within the housing and having a first end fluidly coupled to the turnaround plenum; and an outlet plenum fluidly coupled to a second end of the outlet flow passages to present the fluid.

2. The heat exchanger of claim 1 further comprising (i) a first divider for mounting the first end of the inlet flow passages and mounting the second end of the outlet flow passages, and forming a wall of the inlet plenum and a wall of the outlet plenum, and (ii) a second divider for mounting the second end of the inlet flow passages and mounting the first end of the outlet flow passages, and forming a wall of the turnaround plenum.

3. The heat exchanger of claim 2 wherein the turnaround plenum is substantially annular shaped with a substantially disc shaped center section that is offset towards the center of the housing at the second divider, and a ring shaped section peripherally positioned within the turnaround plenum.

4. The heat exchanger of claim 3 wherein the center section is sized to essentially the same size as the region of the second divider where the inlet flow passages are mounted, and the ring shaped section is sized to essentially the same size as the region of the second divider where the outlet flow passages are mounted.

5. The heat exchanger of claim 3 wherein the center section is separated from the inlet passages at the second divider by a thickness C, the ring shaped section is separated from the outlet passages at the second divider by a thickness R, and the ratio of the thickness C to the thickness R is in a range of 1:1 to 0.1:1.

6. The heat exchanger of claim 1 wherein the inlet flow passages and the outlet flow passages are tubes that are helically twisted.

7. The heat exchanger of claim 1 wherein the inlet flow passages and the outlet flow passages are provided in size or number such that the total cross-sectional area of the inlet of the inlet passages to which the fluid is presented is nominally about 1.5 times the total cross-sectional area of the inlet of the outlet passages to which the fluid is presented.

8. The heat exchanger of claim 7 wherein the ratio of the total cross-sectional area of the inlet flow passages to the total cross-sectional area of the outlet flow passages is in a range of 1:1 to 3:1.

9. The heat exchanger of claim 1 wherein the housing receives a coolant at a coolant inlet and presents the coolant at a coolant outlet, and the coolant flows around the inlet passages and the outlet passages and performs a heat exchange operation on the fluid.

10. The heat exchanger of claim 9 wherein the coolant is air or liquid.

11. The heat exchanger of claim 1 wherein the inlet flow passages and the outlet flow passages are substantially parallel.

12. A method of performing a heat exchange operation using a two-pass, loop flow heat exchanger, the method comprising:

presenting a fluid to be cooled to an inlet plenum;

positioning a plurality of inlet flow passages substantially centrally within a housing and fluidly coupling a first end of the inlet flow passages to the inlet plenum to receive the fluid;

fluidly coupling a turnaround plenum to a second end of the inlet flow passages for reversing the flow of the fluid without mechanical assistance of a moving element;

positioning a plurality of outlet flow passages peripherally within the housing, and fluidly coupling a first end of the outlet flow passages to the turnaround plenum; and fluidly coupled an outlet plenum to a second end of the outlet flow passages to present the fluid.

13. The method of claim 12 further comprising (i) mounting the first end of the inlet flow passages and mounting the second end of the outlet flow passages to a first divider, and forming a wall of the inlet plenum and a wall of the outlet plenum using the first divider, and (ii) mounting the second end of the inlet flow passages and mounting the first end of the outlet flow passages to a second divider, and forming a wall of the turnaround plenum using the second divider.

14. The method of claim 13 wherein the turnaround plenum is substantially annular shaped with a substantially disc shaped center section that is offset towards the center of the housing at the second divider, and a ring shaped section peripherally positioned within the turnaround plenum.

15. The method of claim 14 wherein the center section is sized to essentially the same size as the region of the second divider where the inlet flow passages are mounted, and the ring shaped section is sized to essentially the same size as the region of the second divider where the outlet flow passages are mounted.

16. The method of claim 13 wherein the center section is separated from the inlet passages at the second divider by a thickness C, the ring shaped section is separated from the outlet passages at the second divider by a thickness R, and the ratio of the thickness C to the thickness R is in a range of 1:1 to 0.1:1.

17. The method of claim 12 wherein the inlet flow passages and the outlet flow passages are tubes that are helically twisted.

18. The method of claim 12 wherein the inlet flow passages and the outlet flow passages are provided in size or number such that the total cross-sectional area of the inlet of the inlet passages to which the fluid is presented is nominally about 1.5 times the total cross-sectional area of the inlet of the outlet passages to which the fluid is presented.

19. The method of claim 18 wherein the ratio of the total cross-sectional area of the inlet flow passages to the total cross-sectional area of the outlet flow passages is in a range of 1:1 to 3:1.

20. A two-pass, loop flow heat exchanger, the heat exchanger comprising:

an inlet plenum that receives a fluid to be cooled;

a housing;

a plurality of inlet flow passages substantially centrally positioned within the housing and having a first end fluidly coupled to the inlet plenum to receive the fluid;

a turnaround plenum having an unobstructed passageway fluidly coupled to a second end of the inlet flow passages for reversing the flow of the fluid;

a plurality of outlet flow passages peripherally positioned within the housing and having a first end fluidly coupled to the turnaround plenum; and an outlet plenum fluidly coupled to a second end of the outlet flow passages to present the fluid.

* * * * *